US009358787B2

(12) United States Patent
Matsuhashi

(10) Patent No.: US 9,358,787 B2
(45) Date of Patent: Jun. 7, 2016

(54) RECORDING APPARATUS

(71) Applicant: Seiko Epson Corporation, Tokyo (JP)

(72) Inventor: Kunihiko Matsuhashi, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/801,212

(22) Filed: Jul. 16, 2015

(65) Prior Publication Data

US 2016/0023463 A1 Jan. 28, 2016

(30) Foreign Application Priority Data

Jul. 25, 2014 (JP) ..... 2014-151561

(51) Int. Cl.
*B41J 2/15* (2006.01)
*B41J 2/14* (2006.01)

(52) U.S. Cl.
CPC ..... *B41J 2/1433* (2013.01)

(58) Field of Classification Search
CPC .... B41J 19/147; B41J 2/2114; B41J 2/04506; B41J 2/17
See application file for complete search history.

(56) References Cited

U.S. PATENT DOCUMENTS 7,422,300 B2 * 9/2008 Yamanobe ..... B41J 2/2114 347/14
8,491,078 B2 * 7/2013 Kakutani ..... B41J 2/2107 347/12
2012/0142509 A1 6/2012 Sugai et al.

FOREIGN PATENT DOCUMENTS

JP 2007-008110 A 1/2007
JP 2011-218560 A 11/2011
JP 2012-117982 A 6/2012
JP 2013-078862 A 5/2013
JP 2013-233689 A 11/2013

* cited by examiner

*Primary Examiner* — Lamson Nguyen
(74) *Attorney, Agent, or Firm* — Harness, Dickey & Pierce, P.L.C.

(57) ABSTRACT

A recording apparatus includes a set portion on which a recording medium having a circumferential surface is able to be set; a recording portion having a plurality of nozzle rows that discharge ink; and a rotation mechanism that relatively rotates and moves the recording medium set on the set portion and the recording portion, in which the plurality of nozzle rows includes nozzle rows that discharge a relatively high visibility ink and nozzle rows that discharge a relatively low visibility ink, and are arranged in an intersection direction that intersects a rotation axis of the rotation movement, the nozzle rows that discharge the high visibility ink are arranged on the center side in the ink discharge surface in the intersection direction, and the nozzle rows that discharge the low visibility ink are arranged on the end side in the ink discharge surface in the intersection direction.

6 Claims, 11 Drawing Sheets

RECORDING APPARATUS

BACKGROUND

1. Technical Field

The present invention relates to a recording apparatus.

2. Related Art

In the related art, a recording apparatus that performs recording by discharging a liquid on a recording medium is used. There are cases where recording is performed on recording media with various shapes using such a recording apparatus, for example, cases where recording is performed on the circumferential surface of a recording medium. JP-A-2007-8110 discloses a recording apparatus able to perform recording on a spherical recording medium.

A recording apparatus provided with a recording portion having a plurality of nozzle rows in an ink discharge surface is also used, as disclosed in JPA-2013-233689.

However, in a case where recording is performed on the circumferential surface of the recording medium using the recording apparatus provided with a recording portion having a plurality of nozzle rows in an ink discharge surface, the discharge distance of the ink from the ink discharge surface to the recording medium differs for each nozzle row. Therefore, there is concern of the landing precision for ink discharged from a nozzle row for which the discharge distance of the ink is long being lowered, and of the quality of the recorded image being lowered.

SUMMARY

An advantage of some aspects of the invention is to provide a recording apparatus that records on the circumferential surface of a recording medium having a circumferential surface, in which lowering of the image quality of a recorded image is suppressed.

According to a first aspect of the invention, there is provided a recording apparatus including a set portion on which a recording medium having circumferential surface is able to be set; a recording portion having a plurality of nozzle rows that discharge ink towards the circumferential surface of the recording medium set on the set portion in an ink discharge surface; and a rotation mechanism that relatively rotates and moves the recording medium set on the set portion and the recording portion, in which the plurality of nozzle rows includes nozzle row that discharge a relatively high visibility ink in the recording portion and nozzle rows that discharge a relatively low visibility ink in the recording portion, and is arranged in an intersection direction that intersects a rotation axis of the rotation movement, the nozzle rows that discharge the high visibility ink are arranged on the center side in the ink discharge surface in the intersection direction, and the nozzle rows that discharge the low visibility ink are arranged on the end side in the ink discharge surface in the intersection direction.

In the recording apparatus of a second aspect of the invention, it is preferable that the high visibility ink includes an ink that forms an image on the circumferential surface, and the low visibility ink includes at least one of an ink that forms an underlayer for forming the image and an ink that forms a coating layer that coats the image.

In the recording apparatus of a third aspect of the invention, it is preferable that the nozzle rows that discharge the low visibility ink are arranged on both end sides in the ink discharge surface in the intersection direction.

In the recording apparatus of a fourth aspect of the invention, it is preferable that the recording apparatus further includes nozzle rows that discharge a first ink and nozzle rows that discharge a second ink as nozzle rows that discharge the low visibility ink, in which the nozzle rows that discharge the first ink and the nozzle rows that discharge the second ink are arranged on both end sides.

In the recording apparatus of a fifth aspect of the invention, it is preferable that the ink discharge surface is asymmetrically arranged in the intersection direction of the nozzle rows that discharge the first ink and the nozzle rows that discharge the second ink, when seen from the center side.

In the recording apparatus of a sixth aspect of the invention, it is preferable that the distance between the nozzle rows that discharge the first ink on both end sides and the distance between the nozzle rows that discharge the second ink on both end sides are the same.

According to the aspects of the invention, a recording apparatus is provided that records on the circumferential surface of a recording medium having a circumferential surface, in which lowering of the image quality of a recorded image is suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

FIGS. 1 to 9

Below, the recording apparatus according to Embodiment 1 of the invention will be described in detail with reference to the attached drawings.

Figure 1:
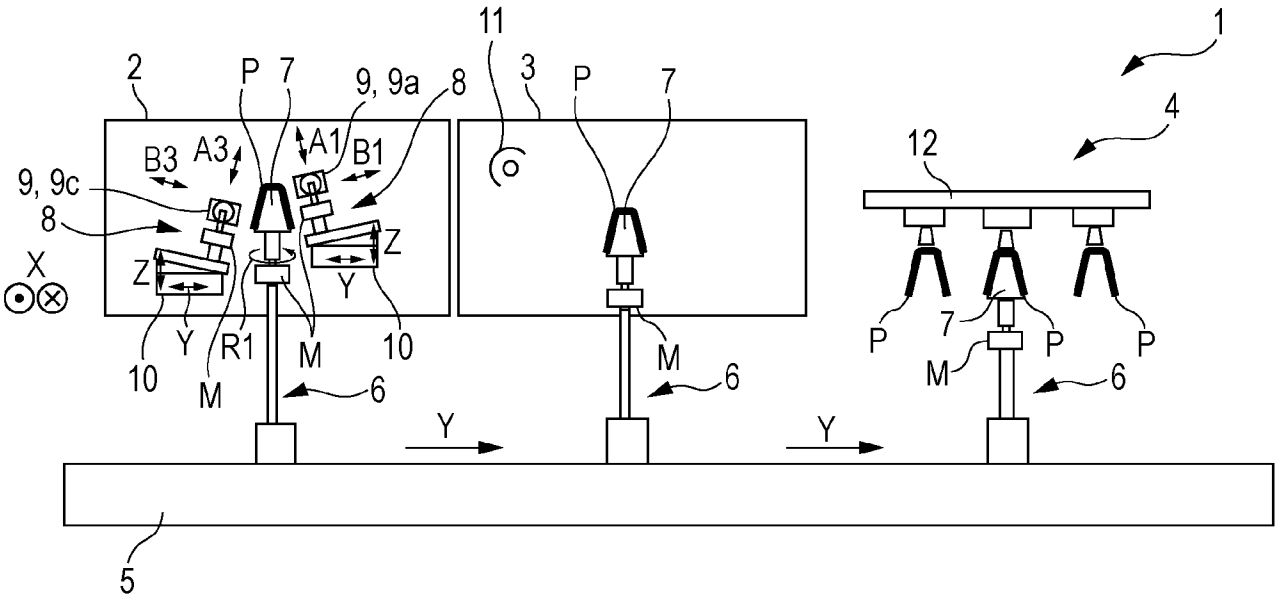
FIG. 1 is a schematic side cross-sectional view showing a recording apparatus according to Embodiment 1 of the invention.

FIG. 1 is a schematic side cross-sectional view showing the recording apparatus 1 of the embodiment of the invention.

The recording apparatus 1 of the embodiment of the invention is provided with recording mechanism 2, a drying mechanism 3, and a supply and discharging mechanism 4, and moves a set portion 6 on which a recording medium P is supported with a support portion 7 by a movement mechanism 5 between the recording mechanism 2, the drying mechanism 3 and the supply and discharging mechanism 4, thereby executing recording.

Here, the recording apparatus 1 of the embodiment of the invention moves the recording mechanism 2, the drying mechanism 3, the supply and discharging mechanism 4, and the set portion 6 in a direction Y, corresponding to the proceeding through recording with the recording mechanism 2, drying with the drying mechanism 3, and supplying and discharging of the recording medium P with the supply and discharging mechanism 4. Although the recording apparatus 1 in the embodiment of the invention has a configuration in which the set portion 6 is moved in the direction Y that is a linear direction, a rotation mechanism may be used so that the set portion 6 moves a circular arc movement path.

In a case where the recording apparatus 1 of the embodiment of the invention is installed horizontally, a direction X and the direction Y are horizontal directions, and a direction Z is a vertical direction.

Initially, the set portion 6 will be described.

Figure 2:
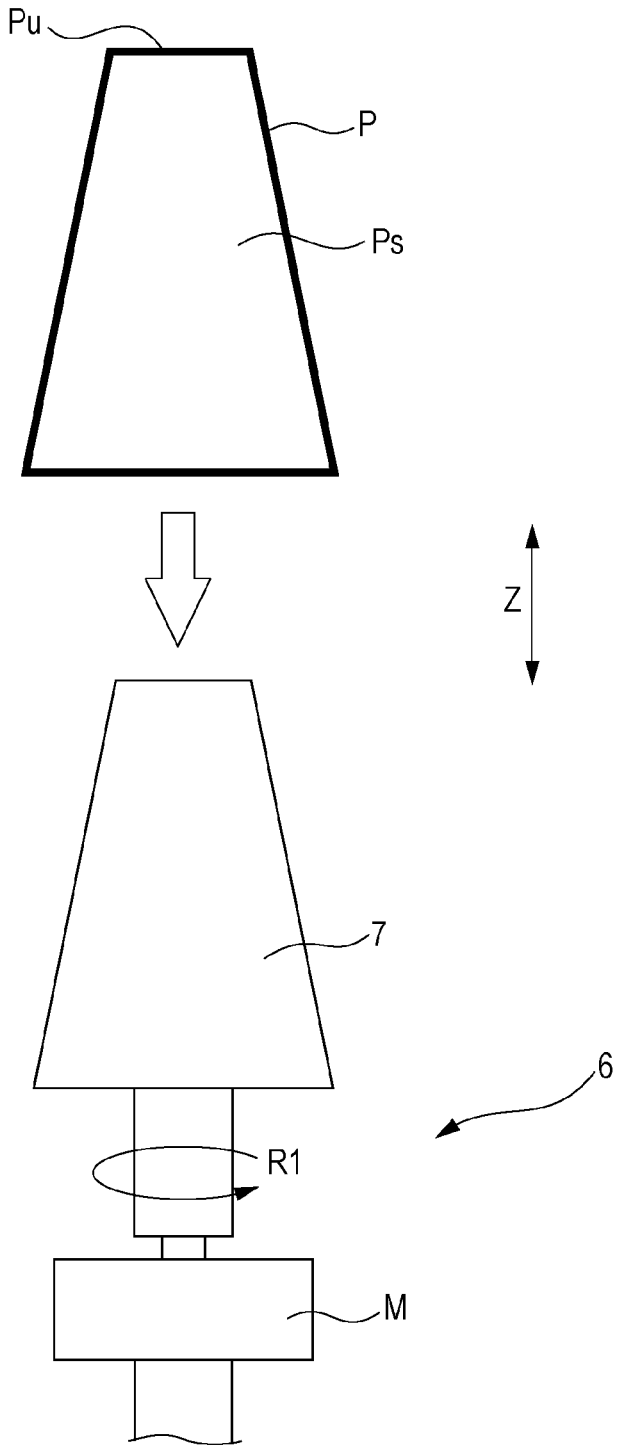
FIG. 2 is a schematic view showing a set portion of a recording medium in the recording apparatus according to Embodiment 1 of the invention.

FIG. 2 is as schematic view of the set portion 6 of the embodiment of the invention.

The set portion 6 includes the support portion 7 that supports by covering the recording medium P, and a motor M that is able to rotate and move, in a rotation direction R1, the support portion 7 on which the recording medium P is supported. The support portion 7 on which the recording medium P is supported is configured to be movable in the direction Z. That is, the set portion 6 serves a role as a rotation mechanism by which the set recording medium P and a recording head 9, described later, are relatively rotated and moved.

The support portion 7 is replaceable, and it is possible to use the support portion 7 with a suitable size and shape corresponding to the shape of the recording medium P.

Next, the recording mechanism 2 will be described.

The recording mechanism 2 is a mechanism that performs recording by discharging ink from the recording head 9 as a recording portion to a circumferential surface Ps of the recording medium P set on the set portion 6, and is a mechanism that performs recording while the recording medium P set on the set portion 6 is rotated in the rotation direction R1.

The wording "circumferential surface" indicates also including the peripheral surface of the recording medium P in which the cross-sectional shape is elliptical, concavo-convex, or the like, in addition to the peripheral surface of the recording medium P in which the cross-sectional shape is a true circle in a case where the recording medium P is cut along an intersection direction C (refer to FIG. 3) that intersects the rotation axis of the recording medium P.

Figure 3:
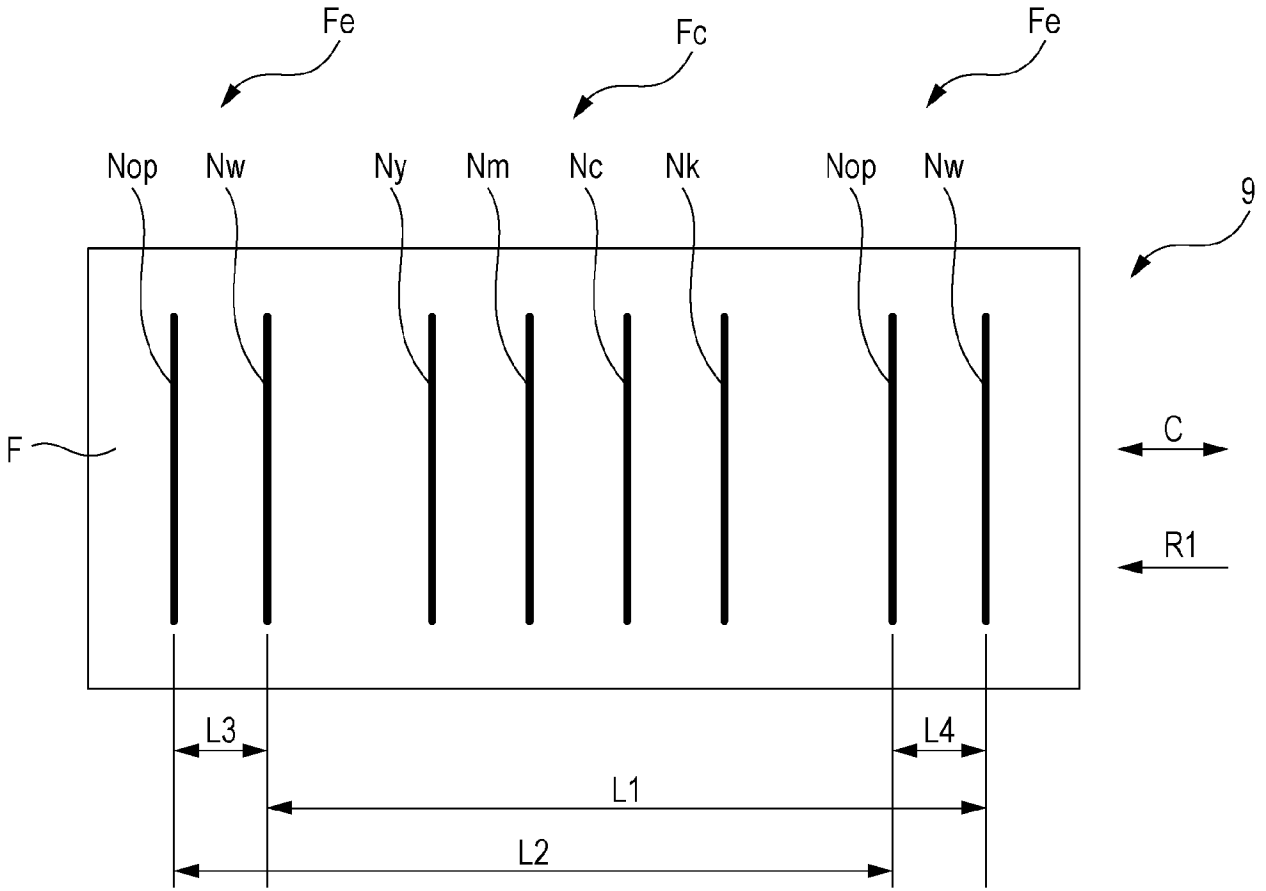
FIG. 3 is a schematic view showing a recording portion of the recording apparatus according to Embodiment 1 of the invention.
Figure 4:
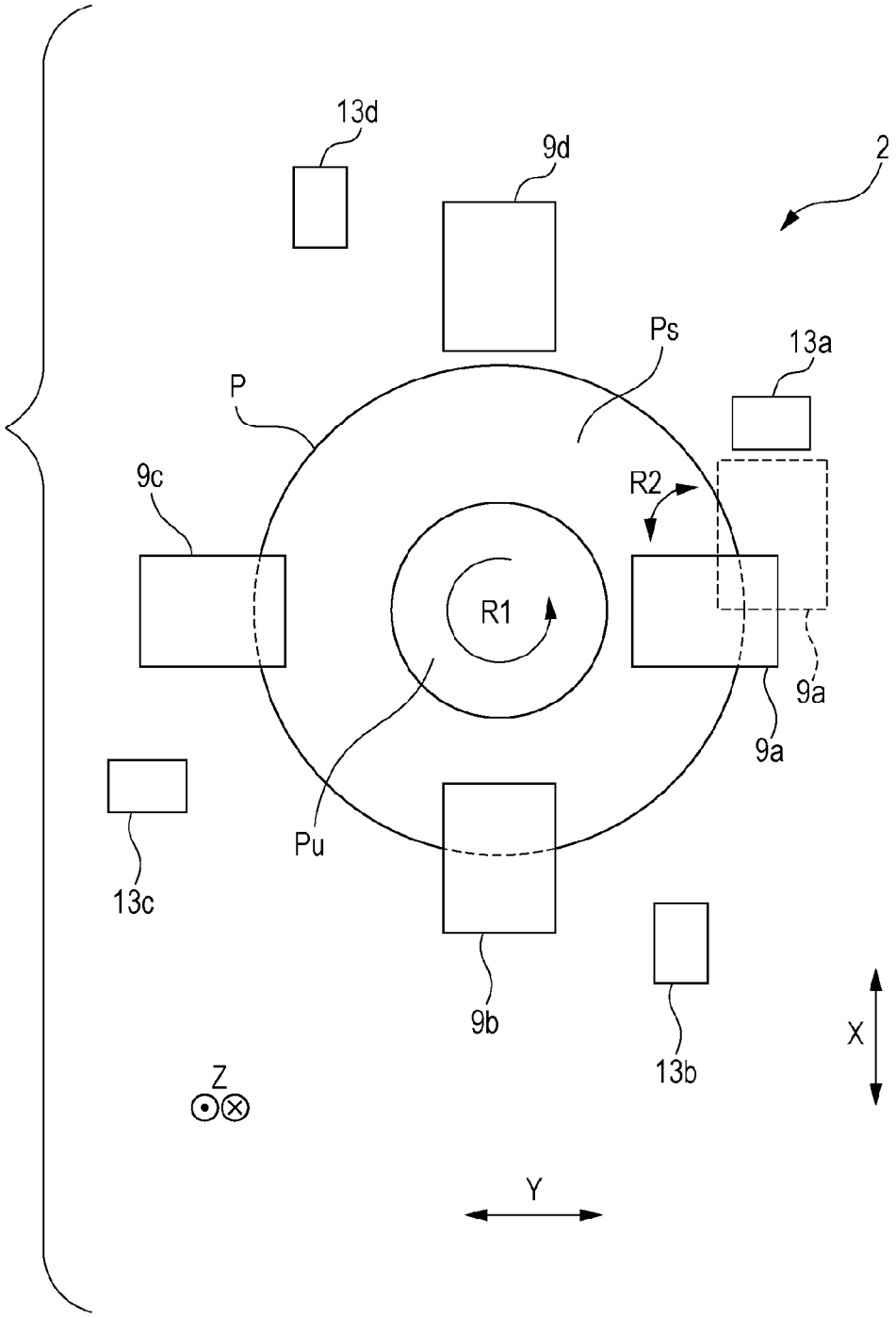
FIG. 4 is a schematic view showing the recording mechanism according to Embodiment 1 of the invention.
Figure 5:
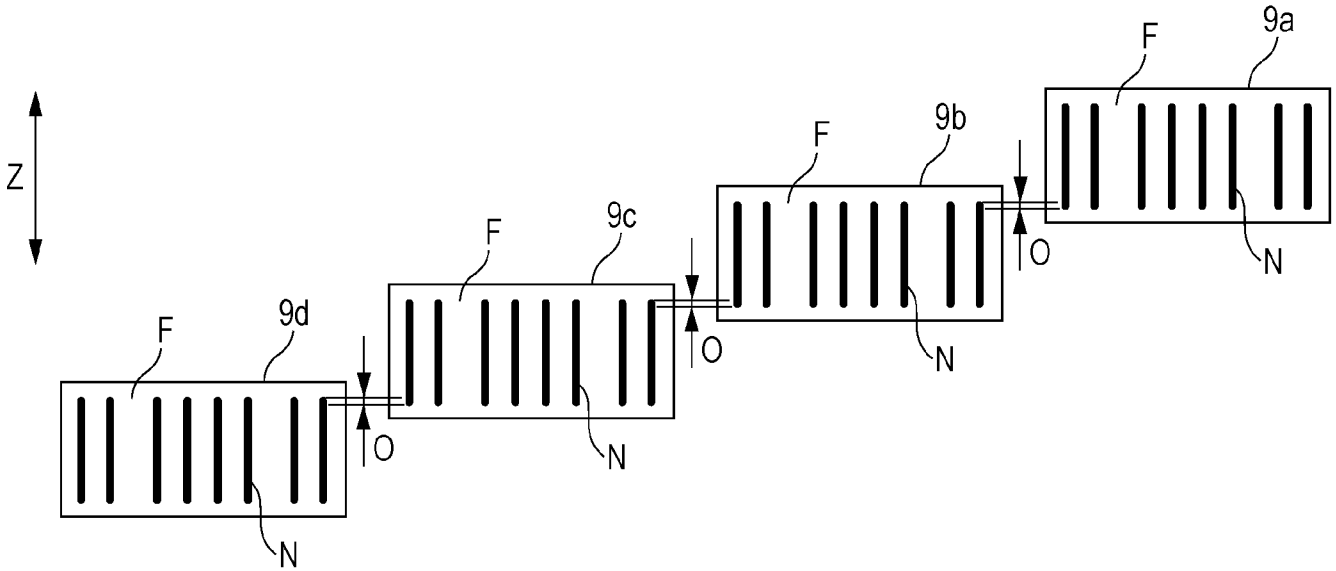
FIG. 5 is a schematic view showing the recording portion of the recording apparatus according to Embodiment 1 of the invention.
Figure 6:
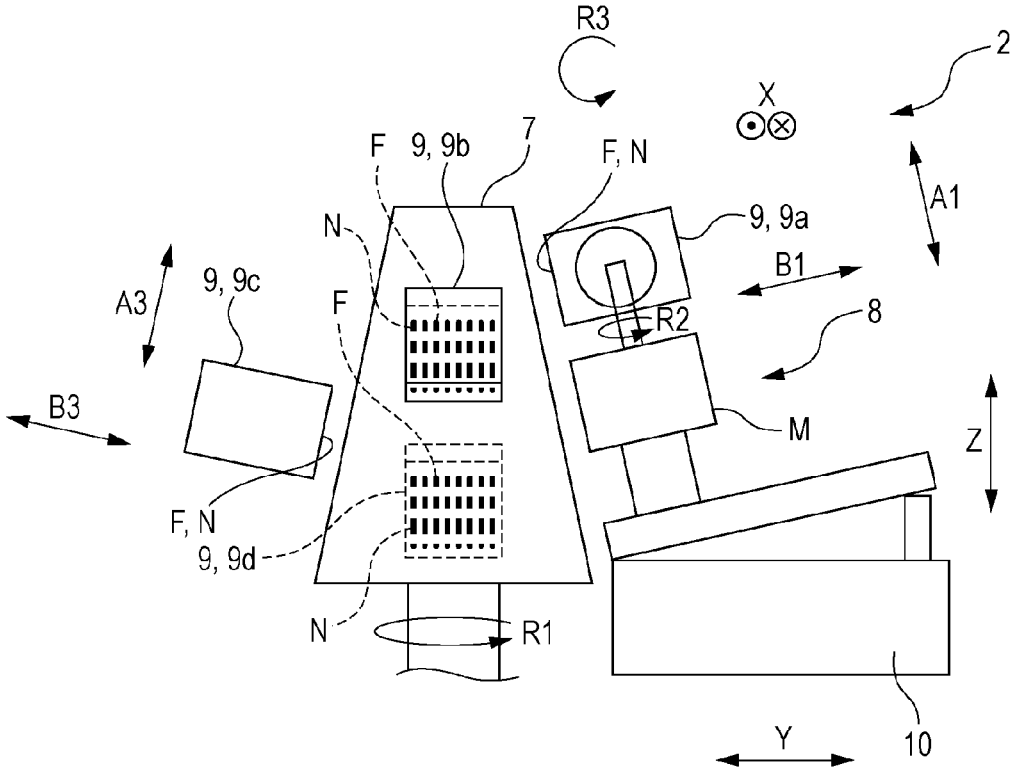
FIG. 6 is a schematic side view showing a recording mechanism according to Embodiment 1 of the invention.
Figure 7:
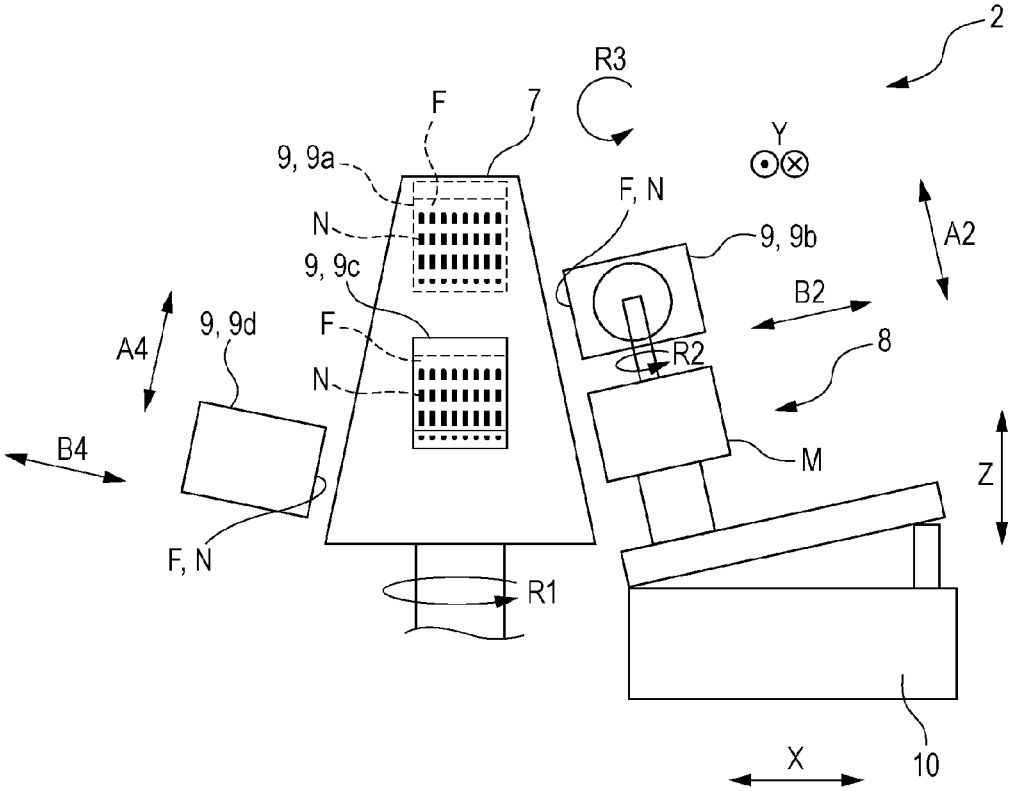
FIG. 7 is a schematic front view showing a recording mechanism according to Embodiment 1 of the invention.
Figure 8:
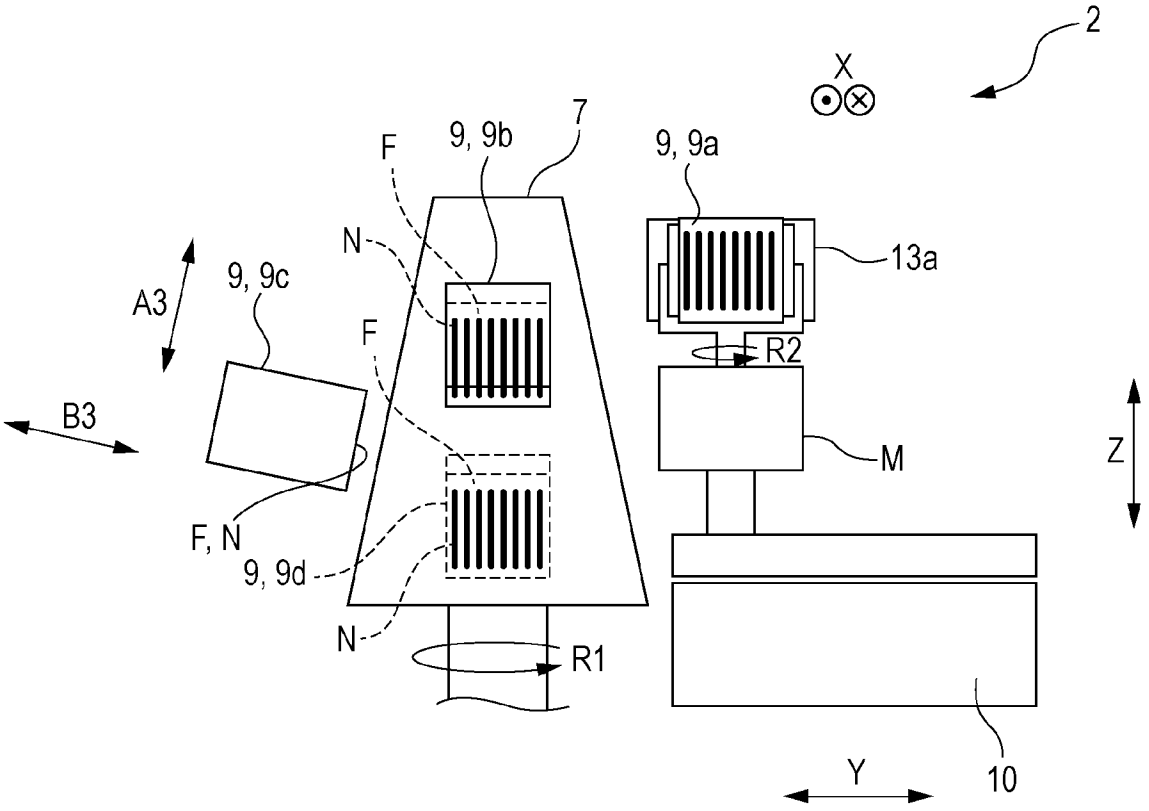
FIG. 8 is a schematic side view showing a recording mechanism according to Embodiment 1 of the invention.

FIG. 3 is a schematic view in which the recording head 9 of the embodiment of the invention is seen from an ink discharge surface F side. FIG. 4 is a schematic plan view of the recording mechanism 2 of the embodiment of the invention. FIG. 5 is a schematic view showing the positional relationship in the direction Z of four recording heads 9 of the embodiment of the invention. FIGS. 6 and 8 are schematic side views of the recording mechanism 2 of the embodiment of the invention. FIG. 7 is a schematic front view of the recording mechanism 2 of the embodiment of the invention.

As represented in FIGS. 4 and 6 to 8, the recording mechanism 2 of the embodiment of the invention includes recording heads 9*a* to 9*e*, and the four recording heads 9. A recording portion movement mechanism 8 is provided corresponding to each recording head 9 of the recording heads 9*a* to 9*e*. The recording portion movement mechanisms 8 corresponding to the recording heads other than recording head 9*a* are not shown in FIGS. 6 and 8, and the recording portion movement mechanisms 8 corresponding to the recording heads other than the recording head 9*b* is not shown in FIG. 7. Although the recording mechanism 2 of the embodiment of the invention includes the four recording heads 9, the number of recording heads 9 is not particularly limited.

As shown in FIGS. 1 and 6 to 8, the recording portion movement mechanism 8 is provided in the base portion 10, and is configured to be movable in the direction Y or the direction X with respect to a base portion 10, and the angle with respect to the base portion 10 is also variable. That is, each recording head 9 is configured to be able to approach and separate with respect to the support portion 7 by means of the recording portion movement mechanism 8.

A plurality of motors M, including those not shown, is provided in the recording portion movement mechanism 8, and each recording head 9 of the recording heads 9*a* to 9*e* is able to rotate and move in a rotation direction R2 and a rotation direction R3 with respect to the recording portion movement mechanism 8.

Each recording head 9 of the embodiment of the invention is movable in the direction X or direction Y, a direction A and direction B with respect to the recording portion movement mechanism 8 by means of a movement mechanism, not shown. Here, the direction A is a direction A1 in the recording head 9*a* (refer to FIG. 6), a direction A2 in the recording head 9*b* (refer to FIG. 7), a direction A3 in the recording head 9*c* (refer to FIG. 6), and a direction A4 in the recording head 9*d* (refer to FIG. 7). Here, the direction B is a direction B1 in the recording head 9*a* (refer to FIG. 6), a direction B2 in the recording head 9*b* (refer to FIG. 7), a direction B3 in the recording head 9*c* (refer to FIG. 6), and a direction B4 in the recording head 9*d* (refer to FIG. 7).

According to such a configuration, the recording mechanism 2 of the embodiment of the invention is able to record at various positions in the circumferential surface Ps of the recording medium P, and is able to record at an appropriate angle and an appropriate distance with respect to recording media P with various sizes and shapes. The configuration is provided with a sensor able to identify the shape of the recording medium P, and it is more preferable that the configuration performs control so that recording is performed by the recording head 9 with an appropriate angle and appropriate distance with respect to the recording medium P based on the shape identified by the sensor. This is so that appropriate recording is possible automatically with respect to recording media P with various sizes and shapes. However, the configuration may manually adjust the angle and the distance with respect to the recording medium P, or may adjust a portion thereof automatically and a portion manually.

Since the recording mechanism 2 of the embodiment of the invention includes a plurality of recording heads 9 able to move in various directions, it is possible to perform recording at a plurality of locations (for example, a plurality of surfaces including a surface such as an upper surface Pu other than the circumferential surface Ps) at the same time.

Here each recording head 9 from the recording head 9*a* to recording head 9*e* of the embodiment of the invention has the same configuration. The details thereof will be described.

The recording apparatus 1 of the embodiment of the invention is able to use a yellow ink, a magenta ink, a cyan ink and a black ink that are high visibility inks for forming an image on the recording medium P. It is possible to also use a white ink for forming an underlayer in a region in which the image is formed or a transparent overprint ink for forming a protective layer for protecting the image formed on the recording medium P. In other words, the recording apparatus 1 of the embodiment of the invention is able to use a white ink that is a low visibility first ink and an overprint ink that is a low visibility second ink. However, the correspondence relationship between the first ink and the second ink may be reversed.

In the embodiment of the invention, it is possible to use a yellow ink, magenta ink, cyan ink, and black ink as the high visibility inks, and the white ink and the overprint ink are possible as the low visibility inks. However, there is no limitation thereto, and it is possible to use inks such as a luminous ink, a fluorescent ink, a glitter ink that includes a metal pigment or the like as the high visibility ink.

Visibility is able to be determined to be high or low by relative comparison between a plurality of types of ink discharged from each recording head. The visibility of the color is greatly influenced by the order of the brightness difference, chroma difference, and hue difference between the background color and the image color. Even in the color scheme of hues differing from one another, a case of a larger brightness difference increases the visibility. In particular, the visibility increases with the color scheme between colors with a high chroma. The visibility may further change according to the color or state of the surfaces Ps or Pu subjected to recording. In other words, the contrast between the color and state of the recording surface also varies. The visibility may also vary by discharging an ink that solidifies such as a UV ink and unevenness occurring on the recording surface.

Therefore, in the recording head 9 of the embodiment of the invention, nozzle rows N able to discharge each of these inks to the ink discharge surface F are formed. In detail, as shown in FIG. 3, a nozzle row Ny for discharging yellow ink, a nozzle row Nm for discharging magenta ink, a nozzle row Nc for discharging cyan ink, a nozzle row Nk for discharging black ink, a nozzle row Nw for discharging white ink, and a nozzle row Nop for discharging the overprint ink are formed.

In further detail, as shown in FIG. 3, the plurality of nozzle rows N are arranged (arrayed) neighboring in the ink discharge surface F in the intersection direction C that is the direction that intersects the rotation axis thereof corresponding to the rotation direction R1 that is the direction of the rotation movement of the recording medium P. As shown in FIG. 3, from the plurality of nozzle rows N, the nozzle rows Ny, Nm, Nc, and Nk that discharge yellow, magenta, cyan and black inks that are high visibility inks that form the image are arranged on a center side Fc of the ink discharge surface F in the intersection direction C. The nozzle rows Nw and Nop that discharge the white ink that is a low visibility ink for forming the underlayer and the transparent overprint ink for forming the protective layer are arranged on an end side Fe of the ink discharge surface F in the intersection direction C.

Although the quality of the recorded image is more greatly influenced by the high visibility ink than the low visibility ink, the recording head 9 of the embodiment of the invention includes nozzle rows that discharge the high visibility ink arranged on the center side Fc and the nozzle rows that discharge the low visibility ink arranged on the end side Fe. In this way, lowering of the quality of the recorded image is suppressed by shortening the discharge distance (the so-called PG) of the ink from the ink discharge surface F to the recording medium P for the high visibility ink instead of lengthening the distance for the low visibility ink.

The effects of these inks is frequently high when recording is performed with the white ink and the overprint ink at a higher coating amount (landing amount) compared to the yellow ink, magenta ink, cyan ink, and the black ink. Therefore, as shown in FIG. 3, the nozzle rows Nw and Nop that discharge the white ink and the overprint ink are arranged on both end sides Fe in the discharge surface F in the intersection direction C. Through such a configuration, the recording head 9 of the embodiment of the invention is able to increase the landing amount on the recording medium P of the white ink and the overprint ink. It is further possible to lengthen the time from landing the ink discharged from the nozzle rows (nozzle rows Nw and Nop on the right side in FIG. 3) on a header side when recording with the white ink and the overprint ink to the landing of the ink discharged from the nozzle rows (nozzle rows Nw and Nop on the left side in FIG. 3) on a rearward side when recording with the white ink and the overprint ink, the time difference from discharge of the nozzle rows of the header side to discharge of the nozzle rows on the rearward side contributes drying and absorption in the recording medium P of the ink discharged from the nozzle rows on the header side, and it is possible to make the reception state on the recording medium P of ink discharged and landed from the nozzle rows on the rearward side favorable. Accordingly, the configuration is able to suppress lowering of the quality of the recorded image due to defects and the like in the spreading of the white ink and overprint ink landed on the recording medium P.

Expressed differently, it can be said that underlayer nozzle rows Nw that discharge the white ink that forms an underlayer and coating layer nozzle rows Nop that discharge an ink that forms the coating layer are arranged on both end sides Fe of the ink discharge surface F of the recording head 9 of the embodiment of the invention. Therefore, in both the white ink and the overprint ink, it can be said that the configuration is able to suppress lowering of the quality of the recorded image.

Here, in cases of performing recording on the circumferential surface Ps of the recording medium P, PG increases towards the end side Fe of the ink discharge surface F. The PG tends to increase as the landing precision of the ink decreases.

Meanwhile, in the ink discharge surface F of the embodiment of the invention, the underlayer nozzle rows Nw and the coating layer nozzle rows Nop are arranged in the order of nozzle row Nw, nozzle row Nop, nozzle row Nw, and nozzle row Nop, when seen from the intersection direction C. Expressed differently, in the ink discharge surface F of the embodiment of the invention, the nozzle row Nw and nozzle row Nop are asymmetrically arranged seen from the center side Fc in the intersection direction C.

That is, it is possible to suppress the nozzle rows Nw from both being on the endmost sides of the ink discharge surface F, and to suppress the nozzle rows Nop from both being on the endmost sides of the ink discharge surface F. Therefore, in both the nozzle rows Nw and the nozzle rows Nop, it is possible to suppress both nozzle rows from two present from both being on the endmost sides, and the landing precision of both inks discharged from both nozzle rows from lowering.

The recording head 9 of the embodiment of the invention, as shown in FIG. 3, is configured so that a distance L1 between two nozzle rows Nw and a distance L2 between two nozzle rows Nop becomes the same. Thus, the time from the white ink discharged from the nozzle row Nw that is the header side during recording landing to the white ink discharged from the nozzle row Nw that is the rearward side when recording landing and the time from the overprint ink discharged from the nozzle row Nop that is the header side when recording landing to the overprint ink discharged from the nozzle row Nop that is the rearward side when recording landing are made substantially the same.

Here, "the distance L1 between two nozzle rows Nw and the distance L2 between two nozzle rows Nop is the same" is not limited to being the same in the strictest sense, and the meaning also includes cases where there is some difference. For example, this signifies cases where the difference between the distance L1 between two nozzle rows Nw provided in both end sides Fe and the distance L2 between two nozzle rows Nop provided on both end sides Fe is shorter than distances L3 and L4 between the nozzle row Nw and the nozzle row Nop on the end side Fe on the same side ($|L1-L2|<L3$, $|L1-L2|<L4$, when expressed as a formula).

Although the recording head 9 of the embodiment of the invention has a nozzle row N configuration such as shown in FIG. 3, the order of the recording ink is white ink that forms an underlayer, color inks consisting of yellow ink, magenta ink, cyan ink, and black ink that form the image, and the overprint ink that forms the protective layer that protects the image. Although it is possible to perform recording with a method in which recording is sequentially completed in order with each of the white, color, and overprint inks for each time the recording medium P is rotated in the rotation direction R1, it is also possible to perform recording in which the recording is sequentially completed with each ink by the recording medium P being rotated a plurality of times in the rotation direction R1. Specifically, for example, it is possible for recording of the underlayer to be completed by the recording medium P initially being rotated four times in the rotation direction R1, recording of the image to next be completed by the recording medium P being rotated four times in the rotation direction R1, and the recording of the protective layer to next be completed by the recording medium P being rotated four times in the rotation direction R1.

Since the drying time of each ink is reduced in cases where the recording with each of the white, color and overprint inks is completed for each time the recording medium P is rotated in the rotation direction R1, a drying mechanism may be provided by including a configuration able to heat the support portion 7, or the like.

Recording may be performed with a method in which recording is completed in one rotation by discharging each ink in the order of the white, color and overprint inks when the recording medium P is rotated in the rotation direction R1 once.

As shown in FIGS. 4 and 8, maintenance portions 13*a*, 13*b*, 13*c*, and 13*d* for maintaining the recording heads 9*a*, 9*b*, 9*c*, and 9*d* are provided in the recording mechanism 2 of the embodiment of the invention. Although the maintenance portions 13*a*, 13*b*, 13*c*, and 13*d* of the embodiment of the invention include a suction mechanism able to suction ink from the nozzle rows N and a wiper that wipes the ink discharge surface F, there is no particular limitation to such a configuration. As shown in FIG. 8, in the recording mechanism 2 of the embodiment of the invention, although the configuration has the maintenance portions 13 opposed by the recording head 9 being rotated and moved in the rotation direction R2 once a state in which the inclination of recording portion movement mechanism 8 with respect to the base portion 10 is eliminated is attained, there is no limitation to such a configuration.

Next, the positional relationship of the recording heads 9*a*, 9*b*, 9*c*, and 9*d* in the direction Z during recording will be described.

Although FIG. 5 shows the positional relationship of the recording heads 9*a*, 9*b*, 9*c*, and 9*d* of the embodiment of the invention in the direction Z during recording, the recording heads 9*a*, 9*b*, 9*c*, and 9*d* are positioned to overlap in the direction Z during recording, as shown in FIG. 5. Specifically, an overlap part O arises in the direction Z on the upper portion of the upper end (other end in the direction Z) of the nozzle row N of the recording head 9*b* further than the lower end (one end in the direction Z) of the nozzle row N of the recording head 9*a*. Similarly, an overlap part O arises in the direction Z on the upper portion of the upper end of the nozzle row N of the recording head 9*c* further than the lower end of the nozzle row N of the recording head 9*b*. Similarly, an overlap part O arises in the direction Z on the upper portion of the upper end of the nozzle row N of the recording head 9*d* further than the lower end of the nozzle row N of the recording head 9*c*. Therefore, the recording mechanism 2 of the embodiment of the invention has a configuration able to consistently perform recording in the direction Z.

Next, the drying mechanism 3 will be described using FIG. 1.

The drying mechanism 3 of the embodiment of the invention includes a heater 11 for heating and drying the ink recorded on the recording medium P through irradiation with infrared rays. However, the configuration of the drying mechanism 3 is not limited to such a configuration, and a configuration in which drying is performed by blowing an airflow with respect to the ink recorded on the recording medium P instead of a configuration in which the ink recorded on the recording medium P is heated and dried may be used.

Next, the supply and discharging mechanism 4 will be described using FIG. 1.

The supply and discharging mechanism 4 of the embodiment of the invention includes a supply and discharging portion 12 for the recording medium P able to cover the recording medium P with respect to the support portion 7 by holding the recording medium P and from which the recording medium P supported on the support portion 7 is able to be removed. However, the configuration of the supply and discharging mechanism 4 is not limited to such a configuration.

Next, the electrical configuration in the recording apparatus 1 of the embodiment of the invention will be described.

Figure 9:
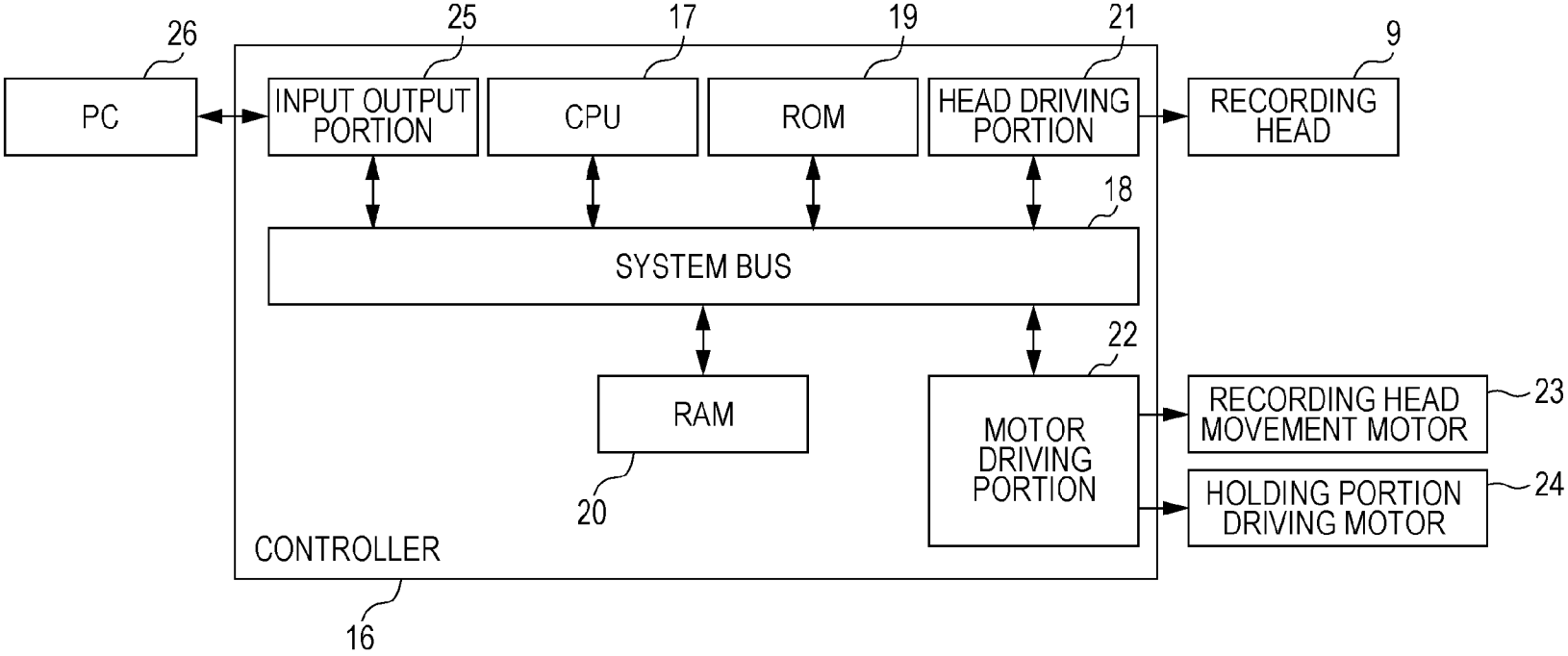
FIG. 9 is a block diagram showing the recording apparatus according to Embodiment 1 of the invention.

FIG. 9 is a block diagram of the recording apparatus 1 of the embodiment of the invention.

A CPU 17 that administers control of the entire recording apparatus 1 is provided in a controller 16. The CPU 17 is connected to a ROM 19 in which various control programs and the like executed by the CPU 17 are stored and a RAM 20 able to temporarily store data via a system bus 18.

The CPU 17 is connected to a head driving portion 21 for driving the recording head 9 via the system bus 18.

The CPU 17 is connected to a motor driving portion 22 via the system bus 18. Here, the motor driving portion 22 is connected to a recording head movement motor 23 and a holding portion driving motor 24.

Here, the recording head movement motor 23 includes all of the motors by which the recording head 9 is moved.

The holding portion driving motor 24 includes a motor for driving the supply and discharging portion 12 in addition to the motor by which the support portion 7 is rotated and moved in the rotation direction R1.

The CPU 17 is further connected to a input output portion 25 via the system bus 18, and the input output portion 25 is connected to a PC 26 to which a variety of information such as recording data or instructions from a user are able to be input.

Embodiment 2

FIG. 10

Next, the recording apparatus 1 of Embodiment 2 will be described in detail with reference to the attached drawings.

Figure 10:
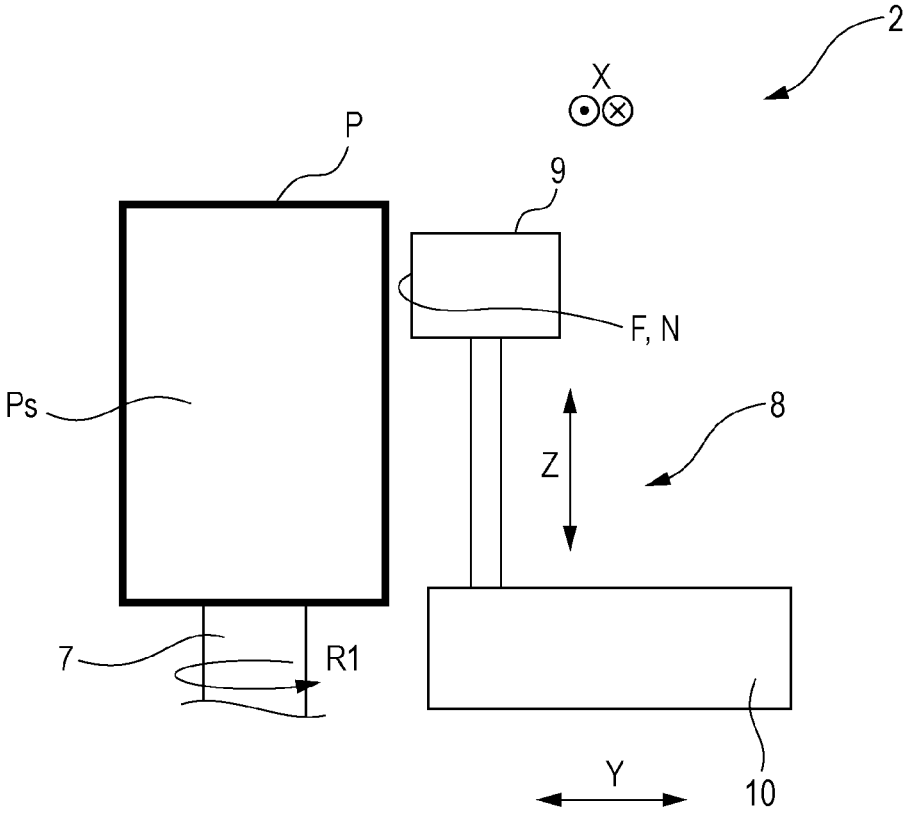
FIG. 10 is a schematic side view showing a recording mechanism according to Embodiment 2 of the invention.

FIG. 10 is a schematic side view showing the recording mechanism 2 that is the main portion of the recording apparatus 1 of Embodiment 2. The constituent members common to the above examples are indicated by the same reference numerals, and a detailed description thereof will not be made.

The recording apparatus 1 of the embodiment of the invention has the same configuration as the recording apparatus 1 of Embodiment 1 other than the configuration of the recording mechanism 2, and the recording head 9 of the embodiment of the invention has the same configuration as the recording head 9 of Embodiment 1.

As shown in FIG. 10, the recording apparatus 1 of the embodiment of the invention has a configuration able to perform recording on the circumferential surface Ps of the recording medium P by one recording head 9 being moved in the direction Y and the direction Z through the recording portion movement mechanism 8 moving in the direction Y (or direction X) and the direction Z with respect to the base portion 10. It is possible for the number of recording heads to be reduced by using such a configuration, possible to reduce the size of the recording apparatus 1, and to suppress costs.

Embodiment 3

FIG. 11

Next, the recording apparatus 1 of Embodiment 3 will be described in detail with reference to the attached drawings.

Figure 11:
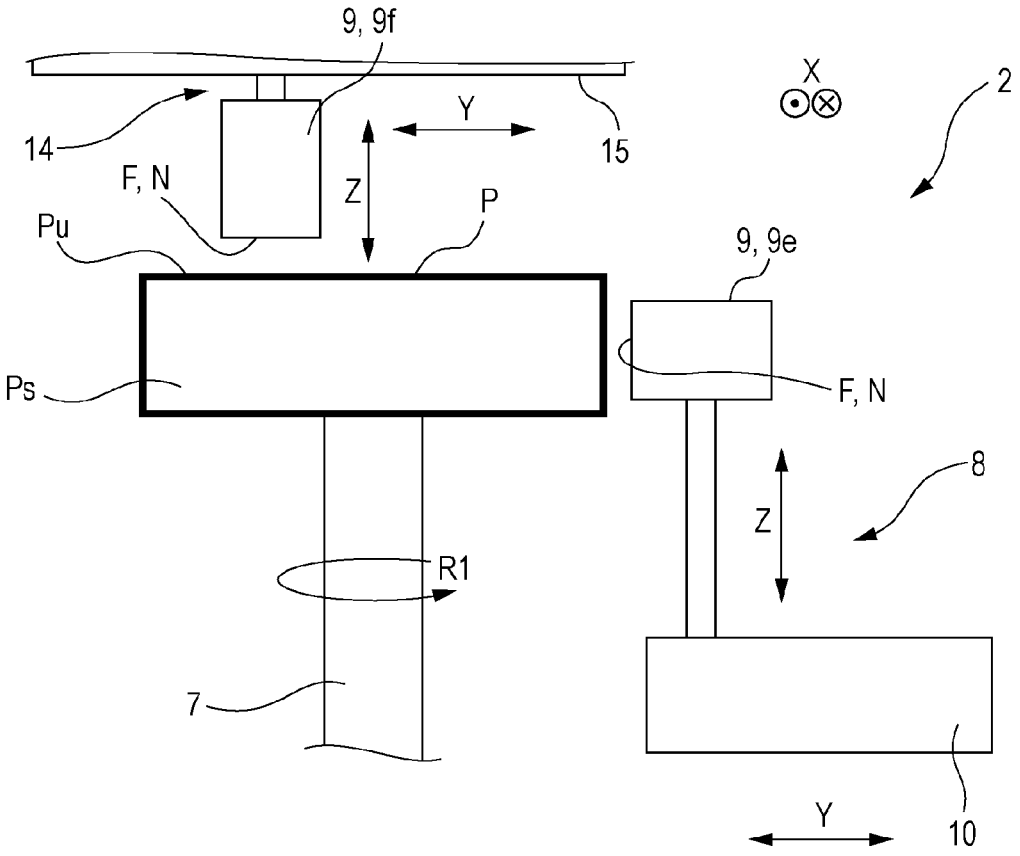
FIG. 11 is a schematic side view showing a recording mechanism according to Embodiment 3 of the invention.

FIG. 11 is a schematic side view showing the recording mechanism 2 that is the main portion of the recording apparatus 1 of Embodiment 3. The constituent members common to the above examples are indicated by the same reference numerals, and a detailed description thereof will not be made.

The recording apparatus 1 of the embodiment of the invention has the same configuration as the recording apparatus 1 of Embodiments 1 and 2 other than the configuration of the recording mechanism 2, and the recording head 9 of the embodiment of the invention has the same configuration as the recording head 9 of Embodiments 1 and 2.

As shown in FIG. 11, the recording apparatus 1 of the embodiment of the invention includes a recording head 9*f* able to perform recording on the upper surface Pu of the recording medium P, in addition to the recording head 9*e* able to perform recording on the circumferential surface Ps of the recording medium P. The recording head 9*e* of the embodiment of the invention is able to move in the direction Z through the recording portion movement mechanism 8 moving in the direction Z with respect to the base portion 10. The recording head 9*f* of the embodiment of the invention is able to move in the direction Y (or direction X) and the direction Z through a recording portion movement mechanism 14 moving in the directions Y and Z with respect to a base portion 15.

Also in the recording apparatus 1 of Embodiment 1, although it is possible to perform recording on the upper surface Pu of the recording medium P by the recording head 9 being moved, in the recording apparatus 1 of the embodiment of the invention, it is possible to perform recording on the upper surface Pu of the recording medium P through a simple control.

The invention is not limited to the embodiments described above and may be modified in various ways within the aspects described in claims, and the modifications should be construed as being included in the invention.

Above, the invention is described based on specific examples. Here, the invention will be again summarized and described.

A recording apparatus 1 of the first aspect of the invention includes a set portion 6 on which a recording medium P having circumferential surface Ps is able to be set; a recording portion 9 having a plurality of nozzle rows N that discharge ink towards the circumferential surface Ps of the recording medium P set on the set portion 6 in an ink discharge surface F; and a rotation mechanism 6 that relatively rotates and moves the recording medium P set on the set portion 6 and the recording portion 9, in which the plurality of nozzle rows N includes nozzle rows Ny, Nm, Nc, and Nk that discharge a relatively high visibility ink among the recording portion 9 and nozzle rows Nw and Nop that discharge a relatively low visibility ink among the recording portion 9, and are arranged in an intersection direction C that intersects a rotation axis of the rotation movement, the nozzle rows Ny, Nm, Nc, and Nk that discharge the high visibility ink are arranged on a center side Fc in the ink discharge surface in the intersection direction C, and the nozzle rows that discharge the low visibility ink are arranged on an end side Fe in the ink discharge surface F in the intersection direction C.

The high visibility ink has a greater influence on the quality of the recording image than the low visibility ink. According to the aspect, the nozzle rows Ny, Nm, Nc, and Nk that discharge the high visibility ink are arranged on the center side Fc of the ink discharge surface F in the intersection direction C, and the nozzle rows Nw and Nop that discharge the low visibility ink are arranged on the end side Fe of the ink discharge surface F in the intersection direction C. That is, it is possible to shorten the discharge distance of the ink from the ink discharge surface F to the recording medium P for the high visibility ink instead of lengthening the distance for the low visibility ink. Therefore, it is possible to suppress lowering of the quality of the recorded image.

The wording "circumferential surface" indicates also including the peripheral surface of the recording medium P in which the cross-sectional shape is elliptical, concavo-convex, or the like, in addition to the peripheral surface of a recording medium P in which the cross-sectional shape is a true circle in a case where the recording medium P is cut along the intersection direction C that intersects the rotation axis of the recording medium P.

In the recording apparatus 1 of the second aspect of the invention, the high visibility ink of the first aspect includes an ink that forms an image on the circumferential surface Ps, and the low visibility ink includes at least one of an ink that forms an underlayer for forming the image and an ink that forms a coating layer that coats the image.

According to the aspect, the low visibility ink includes at least one of an ink that forms an underlayer for forming the image and an ink that forms a coating layer that coats the image. Therefore, at least one of improving the quality of the image through the underlayer and protecting the image through the coating layer is possible.

In the recording apparatus 1 of the third aspect of the invention, it is preferable that the nozzle rows Nw and Nop in the first or second aspects that discharge the low visibility ink are arranged on both end sides Fe in the ink discharge surface F in the intersection direction C.

According to the aspect, the nozzle rows Nw and Nop that discharge the low visibility ink are arranged on both end sides Fe in the ink discharge surface F in the intersection direction C. Therefore, it is possible to increase the landing amount of the low visibility ink on the recording medium P, and possible to lengthen the time from the ink discharged from the nozzle row N on the header side landing during recording with the low visibility ink to the ink discharged from the nozzle row N on the rearward side landing when recording with the low visibility ink. Accordingly, it is possible to suppress lowering of the quality of the recorded image with the low visibility ink.

In the recording apparatus 1 of the fourth aspect of the invention, it is preferable that the recording apparatus of the third aspect further includes nozzle rows Nw that discharge a first ink and a nozzle rows Nop that discharge a second ink as nozzle rows N that discharge the low visibility ink, in which the nozzle rows Nw that discharge the first ink and the nozzle rows Nop that discharge the second ink are arranged on both end sides Fe.

According to the aspect, the nozzle rows Nw that discharge the first ink and the nozzle rows Nop that discharge the second ink are arranged on both end sides Fe. Therefore, in both of the first and second inks, it is possible for lowering of the quality of the recorded image to be suppressed.

In the recording apparatus 1 of the fifth aspect of the invention, it is preferable that the ink discharge surface F of the fourth aspect is asymmetrically arranged in the intersection direction C of the nozzle rows Nw that discharge the first ink and the nozzle rows Nop that discharge the second ink, when seen from the center side Fc.

According to the aspect, the ink discharge surface F is asymmetrically arranged in the intersection direction C of the nozzle rows Nw that discharge the first ink and the nozzle rows Nop that discharge the second ink, when seen from the center side Fc. That is, it is possible to suppress the nozzle rows Nw that discharge the first ink from both being on the endmost sides of the ink discharge surface F, and to suppress the nozzle rows Nop that discharge the second ink from both being on the endmost side of the ink discharge surface F. Therefore, it is possible to suppress the landing precision of both inks discharged from both nozzle rows N from lowering by making both the nozzle rows N the endmost sides, that is, it is possible to suppress the overall landing precision from lowering by suppressing the landing precision in at least one of both of the nozzle rows N from lowering.

In the recording apparatus 1 of the sixth aspect of the invention, in the fifth aspect, it is preferable that a distance L1 between the nozzle rows Nw that discharge the first ink on both end sides Fe and a distance L2 between the nozzle rows Nop that discharge the second ink on both end sides Fe are the same.

Here, the term "the same" is not limited to the strict meaning of same, and the meaning also includes cases where there is some difference.

According to the aspect, the distance L1 between the nozzle rows Nw that discharge the first ink on both end sides Fe and the distance L2 between the nozzle rows Nop that discharge the second ink on both end sides Fe are the same. Therefore, it is possible for the time from the first ink discharged from the nozzle row Nw that is the header side during recording landing to the first ink discharged from the nozzle row Nw that is the rearward side when recording landing and the time from the second ink discharged from the nozzle row Nop that is the header side when recording landing to the second ink discharged from the nozzle row Nop that is the rearward side when recording landing to be made substantially the same.

The entire disclosure of Japanese Patent Application No. 2014-151561, filed Jul. 25, 2014 is expressly incorporated by reference herein.

What is claimed is:

1. A recording apparatus comprising:

a set portion on which a recording medium having circumferential surface is able to be set;

a recording portion having a plurality of nozzle rows that discharge ink towards the circumferential surface of the recording medium set on the set portion in an ink discharge surface; and a rotation mechanism that rotates the recording medium set on the set portion and the recording portion, wherein the plurality of nozzle rows includes at least one nozzle row that discharges a relatively high visibility ink in the recording portion and at least one other nozzle row that discharges a relatively low visibility ink in the recording portion, and wherein the plurality of nozzle rows are arranged in an intersection direction that intersects a rotation axis of rotation, and wherein the at least one nozzle row that discharges the high visibility ink is arranged on a center side in the ink discharge surface in the intersection direction, and wherein the at least one other nozzle row that discharges the low visibility ink is arranged on an end side in the ink discharge surface in the intersection direction.

2. The recording apparatus according to claim 1, wherein the high visibility ink includes an ink that forms an image on the circumferential surface, and the low visibility ink includes at least one of an ink that forms an underlayer for forming the image and an ink that forms a coating layer that coats the image.

3. The recording apparatus according to claim 1, wherein there are at least two nozzle rows that discharge the low visibility ink, one row being arranged on one end of the ink discharge surface in the intersection direction and a second row being arranged on an opposite end side in the ink discharge surface in the intersection direction.

4. The recording apparatus according to claim 3, further comprising:

nozzle rows that discharge a first ink and nozzle rows that discharge a second ink as nozzle rows that discharge the low visibility ink, wherein the nozzle rows that discharge the first ink and the nozzle rows that discharge the second ink are arranged on both end sides.

5. The recording apparatus according to claim 4, wherein the ink discharge surface is asymmetrically arranged in the intersection direction of the nozzle rows that discharge the first ink and the nozzle rows that discharge the second ink, when seen from the center side.

6. The recording apparatus according to claim 5, wherein the distance between the nozzle rows that discharge the first ink on both end sides and the distance between the nozzle rows that discharge the second ink on both end sides are the same.

* * * * *